United States Patent [19]

Garson

[11] 3,958,350

[45] May 25, 1976

[54] SIGN BOARD FOR TRUCK TRAILERS, SEMI-TRAILERS AND SHIPPING CONTAINERS

[75] Inventor: Joseph Garson, Franklin, Mich.

[73] Assignee: Kux Manufacturing Company, Detroit, Mich.

[22] Filed: July 25, 1975

[21] Appl. No.: 599,184

[52] U.S. Cl. ..... 40/129 C

[51] Int. Cl.[2] ..... G09F 7/00

[58] Field of Search ..... 40/125 R, 125 H, 125 K, 40/125 F, 129 C; 403/363; 52/618, 481

[56] References Cited

UNITED STATES PATENTS

| | | | |
|---|---|---|---|
| 400,831 | 4/1889 | Culver | 40/129 C |
| 1,627,473 | 5/1927 | Zilbersher | 40/129 C |
| 1,684,010 | 9/1928 | Campbell | 40/125 R X |
| 2,876,566 | 3/1959 | Harrington | 40/129 C X |
| 3,152,416 | 10/1964 | MacLean | 40/129 C |
| 3,634,960 | 1/1972 | Don Carlos | 40/125 K |
| 3,740,882 | 6/1973 | Lamphere | 40/129 C |
| 3,802,103 | 4/1974 | Neff | 40/129 C |

*Primary Examiner*—Louis G. Mancene
*Assistant Examiner*—Wenceslao J. Contreras
*Attorney, Agent, or Firm*—Cullen, Settle, Sloman & Cantor

[57] ABSTRACT

A sign board for truck trailers, semi-trailers and shipping containers having flat side plates and a series of spaced upright outwardly projecting posts comprises an elongated flat body with appropriate legend thereon, and formed to include a series of projections with said sign board body bearing against said side plates and said projections bearing against said posts. Fasteners interconnect said projections and posts.

8 Claims, 2 Drawing Figures

SIGN BOARD FOR TRUCK TRAILERS, SEMI-TRAILERS AND SHIPPING CONTAINERS

BACKGROUND OF THE INVENTION

Heretofore, common sign boards for trailers were flat and suitably secured to the outer surface thereof. Such flat sign boards normally bridge the posts of the truck side wall but leave a large unsupported sign area subject to snagging by loading equipment or other foreign objects.

BRIEF DESCRIPTION OF THE INVENTION

It is an object of the present invention to provide an improved sign board mounting a predetermined indicia or legend which has formed therein a series of spaced channel like parallel projections corresponding to the spacing of the posts so that the body of the sign board bears against the side plates of the truck and the projections bear against the outer surfaces of the posts. This provides a means by which substantially all portions of the sign board are supportably engaged by the flat truck surfaces.

This and other objects will be seen from the specification and claims in conjunction with the appended drawing.

DRAWING

It will be understood that the above drawing illustrates merely a preferred embodiment of the invention, and the other embodiments are contemplated within the scope of the claims here after set forth.

DETAILED DESCRIPTION OF THE INVENTION

Figure 1:
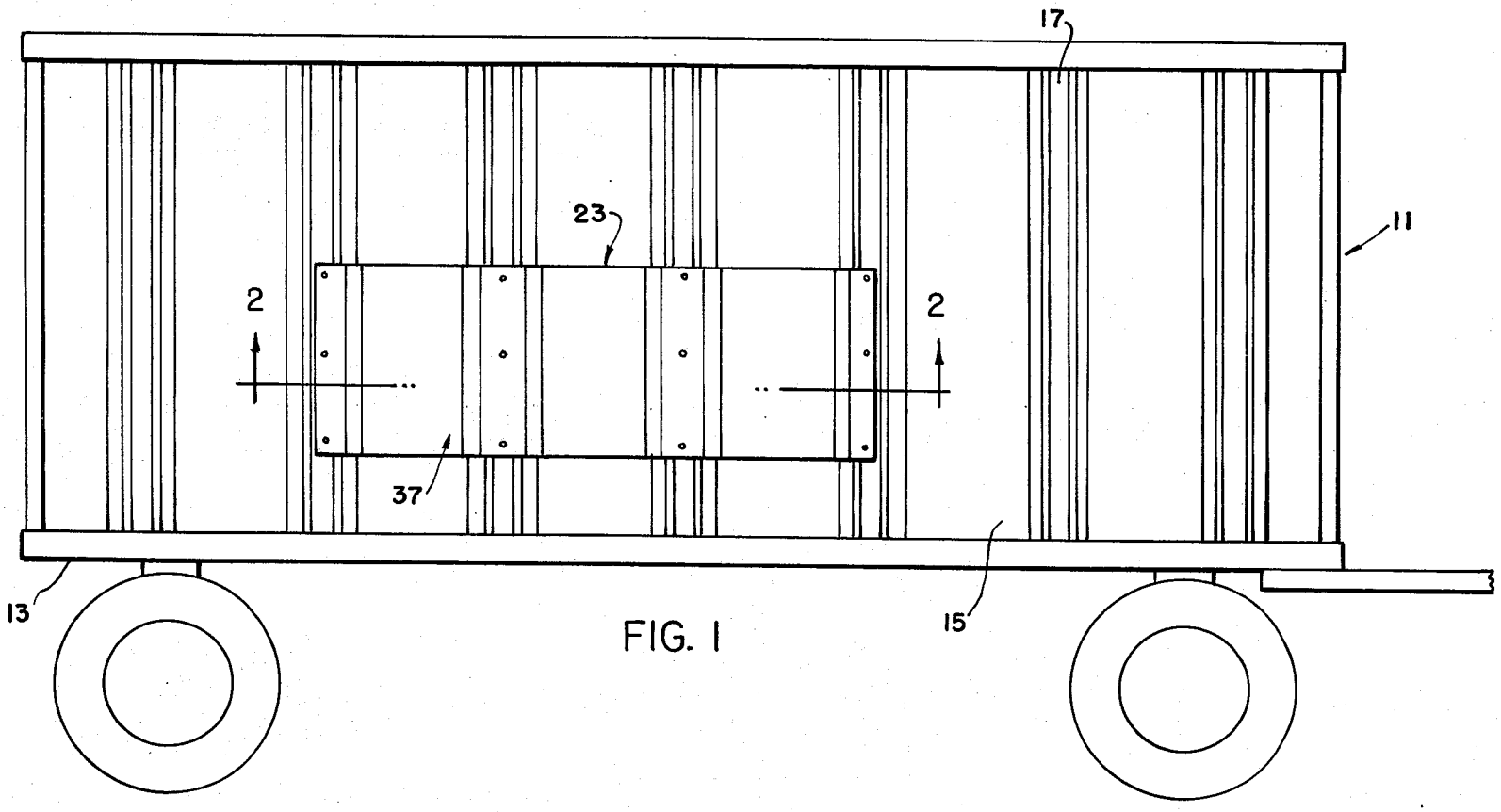
FIG. 1 is a schematic side elevational view of a truck trailer, semi-trailer or a shipping container.

The present invention is directed to a sign board adapted for use in conjunction with truck trailers, semi-trailers or shipping containers such as generally indicated at 11 in FIG. 1, and including a suitable frame 13 on wheels in the case of trailers or trucks.

The trailer or container includes the flat side plates 15 and the conventional exterior posts 17. There are a series of parallel spaced posts projecting outwardly from said side plates, these may be in the form of corrugations or as projections 17 as shown in FIG. 2.

Figure 2:
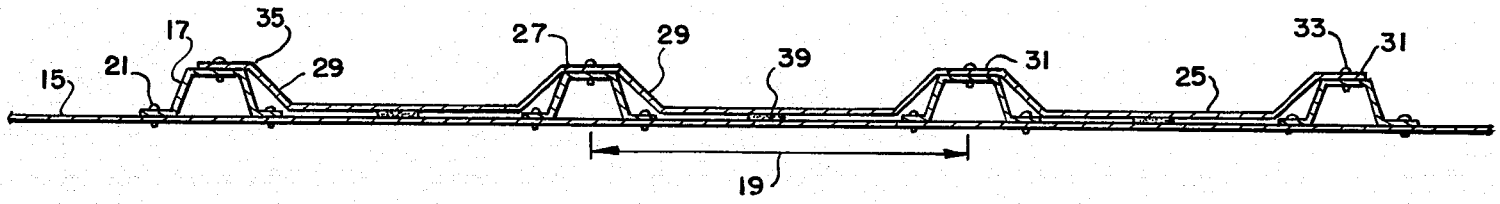
FIG. 2 is a fragmentary section on an increased scale taken in the direction of arrows 2—2 of FIG. 1.

Said side posts or formations on the conventional trailer side wall are at uniform predetermined spacing such as indicated at 19 FIG. 2. Such spacing 19 may be varied between posts depending upon the make of trailer or container.

In the illustrative form shown in the drawing said parallel spaced outwardly projecting posts 17 are affixed to the trailer side plates by a series of fasteners such as rivets 21.

The present improved sign board 22 has a flat body 25 and formed thereon are a series of parallel spaced lateral channel projections 27 and half channel end formations 35.

Said channel formations 27 and end formations 35 are formed at uniform center distances corresponding to the cetner distance indicated at 19 in FIG. 2 in order to properly overlap the corresponding trailer posts.

These dimensions maybe varied or altered corresponding to the predetermined spacing for the posts of the trailer or container involved.

Each of the channel formations include outwardly tapered portions 29 and flat portions 31 for cooperative registry with the outer surfaces of the respective posts and securing thereto as by fasteners 33. One preferred form of fastener is the rivet shown.

The formations 35 are in the nature of half channels which include one outwardly tapered portion 29 and one flat portion 31 so as to end with and register over the outer of the posts.

Before forming of the sign body suitable indicia or legend 37 is imprinted or otherwise applied thereto.

The sign board formations 27 and 35 are generally wider than the corresponding post 17 in order to accommodate different post widths. In other words the widths of the formations 27 and 35 are greater then the widest commonly used posts for trucks, trailers or shipping containers.

The sign board thus spans and is secured to the corresponding posts 17 as by the fasteners 33. A suitable adhesive 39 is interposed between corresponding adjacent surface portions of the sign board and trailer side plate. The flat surface portions of the sign board are normally in substantial cooperative registry with the trailer side plates for proper support thereby. In FIG. 2 there is a small exaggeration showing a space which would normally accommodate the adhesive 39. Actually the surface portions of the sign board are supportably engaged by the vehicle side plates with a sufficient amount of adhesive 39 interposed.

By this construction the sign is firmly affixed to the trailer side wall with a minimum amount of unsupported sign area. This also provides further protection for the sign against damage and at the same time eliminates vibration or rattle.

The present sign board is constructed to fit over two or more posts, there being no limit to the length or number of posts to be covered by a particular sign. Formation 29 is preferably tapered so as not to obstruct reading matter 37 on the sign board. An example of such adhesive is silaprene, made by Silaprene Corporation, Ltd.

Having described my invention, reference should now be had to the following claims.

I claim:

1. In combination with a truck trailer, semi-trailer or shipping container having flat side plates and a series of spaced upright posts, whose side edges project outwardly of said plates, a sign board having an elongated flat body with appropriate legend printed thereon, and formed to include a series of longitudinally spaced parallel projections corresponding to the spacing of said posts, said body bearing against said side plates and said projections bearing against the outer surfaces of said posts; and fastening means interconnecting said projections and posts.

2. In the combination of claim 1, additional fastening means interposed between said side plates and body.

3. In the combination of claim 2, said additional fastening means being an adhesive.

4. In the combination of claim 1, said fastening means being rivets.

5. In the combination of claim 1, said sign board formations being generally wider then the posts to accommodate the widest commonly used post.

6. In the combination of claim 1, the intermediate projections on said body being of channel form and the end projections being half channels.

7. In the combination of claim 6, said projection channels and half channels having sides outwardly diverging from the body and flat outer portions.

8. In combination with a support having an upright flat side plate and a series of spaced upright posts whose side edges project outwardly of said plate;

an elongated flat body with appropriate legend printed thereon, and formed to include a series of longitudinally spaced parallel projections corresponding to the spacing of said posts, said body bearing against said side plate and said projections bearing against said posts; and fastening means interconnecting said projections and posts.

* * * * *